US005762567A

United States Patent [19]

Antonious

[11] Patent Number: 5,762,567

[45] Date of Patent: Jun. 9, 1998

[54] METAL WOOD TYPE GOLF CLUB HEAD WITH IMPROVED WEIGHT DISTRIBUTION AND CONFIGURATION

[76] Inventor: Anthony J. Antonious, 7738 Calle Facil, Sarasota, Fla. 34238

[21] Appl. No.: 485,146

[22] Filed: Jun. 7, 1995

Related U.S. Application Data

[63] Continuation-in-part of Ser. No. 362,897, Dec. 23, 1994, Pat. No. 5,643,104, and Ser. No. 280,177, Jul. 25, 1994, Pat. No. 5,482,279.

[51] Int. Cl.[6] ..... A63B 43/00

[52] U.S. Cl. ..... 473/345; 473/350

[58] Field of Search ..... 473/305, 315, 473/306, 345, 350, 327

[56] References Cited

U.S. PATENT DOCUMENTS

| | | | |
|---|---|---|---|
| 4,995,609 | 2/1991 | Parente et al. | 273/80.2 |
| 5,028,049 | 7/1991 | McKeighen | 273/167 H |
| 5,203,565 | 4/1993 | Murray et al. | 473/327 |
| 5,328,176 | 7/1994 | Lo | 473/342 |
| 5,377,986 | 1/1995 | Viollaz et al. | 473/350 |
| 5,527,034 | 6/1996 | Ashcraft et al. | 473/345 |

*Primary Examiner*—Vincent Millin
*Assistant Examiner*—Charles W. Anderson
*Attorney, Agent, or Firm*—Finnegan, Henderson, Farabow, Garrett & Dunner, L.L.P.

[57] ABSTRACT

A metal wood-type golf club head has an improved weight distribution and configuration through the inclusion of a ledge interfacing with the ball striking face and upper surface and a peripheral mass positioned along at least the majority of the ball striking face and the crown of the club head and vertical masses behind the ball striking face thereby providing added strength and stability to the club head and minimizing pinging of the club head when the ball contact is made. The club head also has an extended hosel integrally connected to the club head body, and the hosel is preferably connected to the peripheral mass.

31 Claims, 18 Drawing Sheets

METAL WOOD TYPE GOLF CLUB HEAD WITH IMPROVED WEIGHT DISTRIBUTION AND CONFIGURATION

This is a continuation-in-part application of Ser. No. 08/362,897, filed on Dec. 23, 1994 now U.S. Pat. No. 5,643,104 and Ser. No. 08/280,177, filed on Jul. 25, 1994, now U.S. Pat. No. 5,482,279 the contents of which are relied upon and incorporated by reference.

BACKGROUND AND SUMMARY OF THE INVENTION

The present invention relates to metal wood type golf club heads and, in particular, to a metal wood club head having an improved configuration, weight distribution, and hosel construction.

Many wood-type golf club heads are now made of metal. The conventional metal wood-type clubs are formed with a relatively thin face and a thin metal shell, which typically surrounds a foam filled cavity. The club faces of conventional metal wood club heads join or interface with the upper crown portion, side walls, and the sole plate of the club head. Generally, there is no significant additional mass provided where the club face connects with these other parts of the club head. Some of these club heads have reinforced ball striking faces to add strength and stability at the point where a golf ball is struck.

A recent tendency has been to make these types of club heads larger, making them more attractive to the golfer and also easier to hit. Such metal woods, because of their larger sizes, generally have thinner club faces and even thinner upper crowns and surrounding walls.

This design structure has created many problems in the industry because such metal wood club head structures may incur cave-ins at the club face stress cracks in the surrounding walls, and buckling at the upper crown portions of the club head when golf balls are struck repeatedly with great force. Moreover, these types of metal woods often must be filled with foam, because of the otherwise high noise level in the form of a pinging or tinning sound, generated when ball contact is made. Foaming adds to the cost of production and leads to other problems, such as the selection of the right kind and amount of foam to completely fill the shells, so that foam serves it purpose and does not come loose after the club has been used.

Various attempts have been made to reinforce metal wood-type golf club heads as evidenced by the U.S. Pat. No. 3,847,399 to Raymont which reinforces the rear inner surface of the ball striking face with a honeycomb structure and my own U.S. Pat. No. 5,141,230, which reinforces the interior of a metal wood with a first mass located behind the ball striking face and a second mass under the upper or crown surface of the club head. These and other attempts at strengthening and modifying the structural integrity of conventional metal woods have experienced varying degrees of success.

The invention comprises a metal wood-type golf club head comprising a shell body having a toe, heel, upper surface, bottom surface, a hosel, a ball striking face, and a rear surface of the ball striking face inside the shell body, and a ledge which comprises a frontal portion of the upper surface, the ledge interfacing with the ball striking face, extending in a heel to toe direction along at least half of the ball striking face, and extending rearwardly to join with the remaining portion of the upper surface of the club head at an upwardly projecting transitional interface.

The invention also comprises a metal wood-type golf club head comprising a shell body having a toe, heel, upper surface, bottom surface, a hosel, a ball striking face, and a rear surface of the ball striking face in the shell body, a ledge which comprises a frontal portion of the upper surface, the ledge interfacing with the ball striking face, extending in a heel to toe direction along at least half of the ball striking face, and extending rearwardly to join with the remaining portion of the upper surface of the club head at an upwardly projecting transitional interface, and a peripheral mass positioned in the shell body along at least a majority of the interface of the ball striking face and the ledge of the club head, thereby providing added strength and stability to the club head.

The present invention is uniquely applicable to metal wood-type golf club head designs. The peripheral mass, which also serves as reinforcement member, extends at least along the majority of the top of the frontal body section, or ball striking face, and preferably extends around the entire periphery of the frontal body section where the outer walls of the shell and the frontal body section interface. Another feature of the preferred embodiment is an integral connection between the hosel and the frontal body section, in a shankless configuration. The hosel preferably extends into and is connected with the peripheral mass adjacent the heel of the club head.

This unique metal wood configuration, particularly the use of the peripheral weighting and reinforcement system, acts as a buffer to prevent buckling and minimize excessive shock and vibration which occurs when a golf ball is struck. The invention eliminates disastrous buckling of the club face and/or the walls of the upper crown and sides of the club head. Furthermore, by overcoming the flexing of the upper crown from the knock-back effect at impact, the noise level is greatly reduced over that of the conventional metal wood-type club heads. Consequently, foaming is often not required to suppress undesired noise levels, and additional bracing is generally not required to provide additional inner support to the shell walls.

The metal wood-type golf club head of the present invention also provides greater stability at impact and provides increased club head resistance to twisting and torquing, especially when hitting golf balls from thick or heavy grass conditions, or when off-center ball contacts are made. The present invention also provides a more even distribution of mass to produce more solid ball contact, for greater distances and improved accuracy.

Conventional metal wood type club heads also include a hosel structure which is integrally formed and which transitions into the club head body whereby the outer surfaces of the hosel assembly smoothly transitions into the outer surfaces of the club head body particularly in the heel area of the club head.

Generally, the base of traditional hosels for metal wood type clubs are formed on the crown portion or upper surface of the club head adjacent the heel area. For some types of metal woods, the hosel extends through the upper surface of the crown and into the shell cavity below. In this type of hosel-socket construction the end of the shaft is located at the crown surface or just below it extending a little into the shell cavity. Since the shaft is the main source of power, the energy transfer takes place primarily at the upper portion of the club head where it is substantially away from the CG or center of percussion. Full golf swings produce considerable club head twisting and torquing, especially at the base of traditionally formed hosels. This has always been the cause of consistent problems such as broken shafts and bent or loose shafts.

The present invention also relates to a golf club head structure wherein at least a significant portion of the hosel is spaced from and specifically located outside the outer surface of the shell section of the club head body adjacent the club's heel area in addition to the peripheral weighting and reinforcement system described above.

The unique structural design of the present invention eliminates or greatly minimizes prior art problems. This is accomplished by having a substantial portion of the hosel and shaft socket formed beyond the outer club head wall at the heel area. Preferably, the outer wall of the shell, at the critical heel area, and the outer-type hosel and socket are joined along most, if not all, of the height of the outer wall, thereby creating a much stronger structural bond at this critical area. The juncture extends along at least one half of the height of the outer wall, more preferably along three quarters of the outer wall. The circumferential wall of the hosel that forms a socket for a club shaft extends downward beyond the crown of the club head shell and into the shell cavity. This unusual hosel construction minimizes the amount of uncontrolled and undesirable club head distortions and adverse rotational deviations that typically occur when a conventional club head is swung and strikes a golf ball. The longer and wider surface connections between the thin walls of the club head shell and the thicker walls of the hosel absorb much more of the metal stress, and are less affected or damaged by the "shock-impact" that occurs to club heads when hitting golf balls. Applying additional controlled leverage is more easily achieved and with less effort in executing shots that require "drawing" or "fading" the ball when desired.

Importantly, the construction of and location of the outside hosel and shaft socket of this invention permits a greater transfer of energy closer to the CG or center of percussion. This improvement delivers more "solid" ball contact repeatedly, producing more accurate hits and longer distances. Further, this hosel construction produces less vibration and greater cushioning in absorbing the shock to hands upon initial ball contact and/or ground contact, particularly when off-center hits occur.

In some embodiments, the shaft socket of the hosel extends to a point adjacent the bottom surface plate or bottom of the club head. For some preferred embodiments, the shaft may extend through the shaft-socket to create a "bore through" type hosel. However, for all such models, at least a substantial part of the "bore through" occurs outside the shell cavity unlike other so called bore-through metal wood club heads wherein their shafts pass through the shell cavity and extend through the bottom surface plate of the club head.

In some preferred embodiments, the club head also includes a peripheral mass immediately behind and around all or part of the outer perimeter of the ball striking face or frontal portion. This peripheral mass serves as a reinforcement member which extends around the entire periphery of the frontal body section where the outer walls of the frontal body section interface.

In other embodiments, the front surface of the outer hosel serves as a continuation of the club head face, while the rear surface of the outer hosel transitions into the heel wall of the shell body of the club head. This wrap around embodiment provides a larger hitting surface along with increased strength and stability, when compared to conventional designs.

Among the objects of the present invention are the provisions of a metal wood-type golf club head providing greater control and square-clubface stability at impact, and which substantially enhances club head resistance to twisting and torquing, as well as other adverse effects from club head knock-back that occurs especially when hitting golf balls from thick or heavy grass conditions or when off-center ball contact occurs.

Another object is the provision of a metal wood type golf club head having a unique hosel construction with at least a portion of its outer surface partially spaced from the body of the club head to create increased club head speed and stability and more leverage by maximizing energy transfer from the shaft to the club head when a golf ball is struck to achieve optimum distances. These and other objects will become apparent with reference to the accompanying drawings and specification.

DESCRIPTION OF THE PREFERRED EMBODIMENTS

Figure 1:
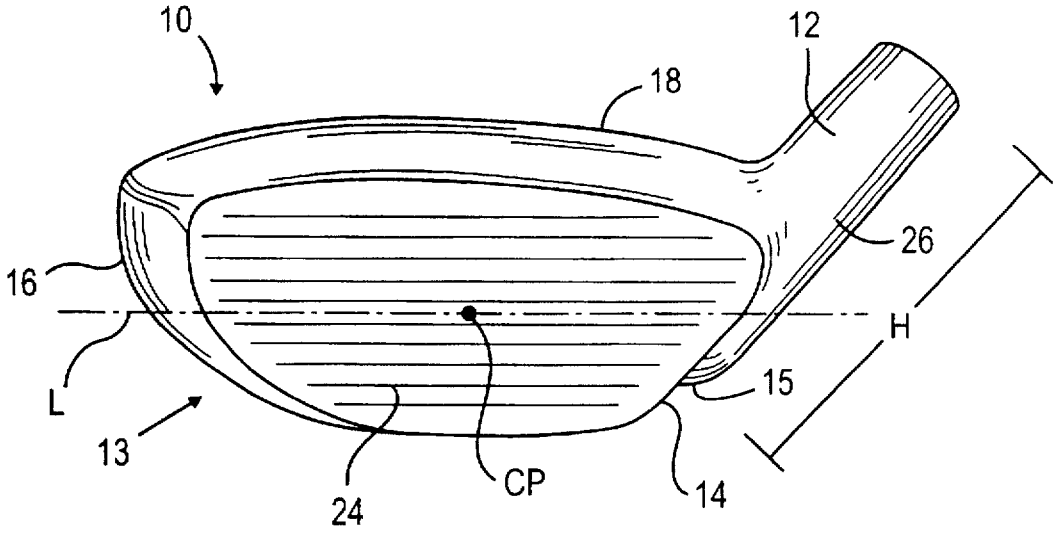
FIG. 1 is a front elevational view of a metal wood type golf club head in accordance with the present invention.

The present invention represents an improvement over such conventional metal wood-type club heads and relates to a metal wood-type golf club head having a unique configuration, weight distribution, and structure. The invention includes an inner peripheral weighting and reinforcement system formed along all or a portion of the interface between the ball striking face and the crown, side walls, and bottom of the club head. The invention also includes a shankless hosel construction in which the entire hosel is spaced from and behind the ball striking face. Preferably, the hosel of the club head is connected to not only the outer surfaces of the club head adjacent the heel but also to the peripheral weighting and reinforcement system.

The peripheral weighting and reinforcement system takes the form of an additional mass of metal positioned at least along the majority of the interface of the ball striking face and crown of the club head, and preferably along the interface of the ball striking face and the side walls, as well as the bottom. This additional mass is thicker than the respective walls of the ball striking face and crown, side walls and bottom of the club head proximate this added mass and adds strength and stability to the resultant club head.

The present invention, several embodiments of which are disclosed below, should in most, if not all, instances permit the golf club head to be made and used without foaming the internal cavity, since the noise and detrimental vibration forces are significantly minimized, if not eliminated, by the invention. The club head structure further provides a metal wood-type golf club head which eliminates the possibility of the ball striking face caving in, cracking, or creating other distortions of the crown, bottom, or side walls of the club head due to the forces which occur when a golf ball is struck during the execution of a golf stroke.

FIGS. 1 to 7 illustrate a first embodiment of a golf club head 10 in accordance with the present invention. The golf club head includes a shell body 13 including a heel 14, toe 16, upper surface or crown 18, bottom surface 20, rear surface 22 and ball striking face 24. The club head 10 also includes a hosel 12 which in each embodiment extends, at least in part, outwardly, in a toe to heel direction, beyond the shell body 13 at the heel area of the club. As can be seen particularly with reference to FIGS. 1, 3 and 4, the hosel 12 includes an outer portion or extension 26 formed outside of the outer surface of the shell body 13 at the heel 14 of the club head 10.

In the embodiment illustrated in FIGS. 1–7, it is preferable that at least one-third of the overall diameter of the hosel 12 extends beyond the shell body 13 of the club head 10, forming a bulge or protrusion on the heel 14 of the club head 10. In this embodiment, the portion of the hosel that extends beyond the shell body 13 more preferably extends at least one half the outer diameter of the hosel 12 and most preferably extends approximately two-thirds of that distance. As explained in more detail below, the extension of the hosel beyond the outer surface of the heel portion of the shell body 13 provides increased leverage and power.

As shown in the drawings, the hosel 12 connects with heel 14 of the shell body 13 of the club head along at least one half of its height H (See FIG. 1) at the heel and more preferably along at least two-thirds of that height. As a result, a bottom edge of the hosel 12 extends at least to, and preferably beyond, a line "L" drawn through the center of percussion of the club head and parallel to the bottom surface of the club head, providing an extremely strong and stable connection. Similarly, the hosel 12 preferably is designed to include a shaft socket that will accept a shaft extending along the entire length of the hosel, so that the shaft will extend at least to, and preferably beyond, the club head's center of percussion.

Figure 7:
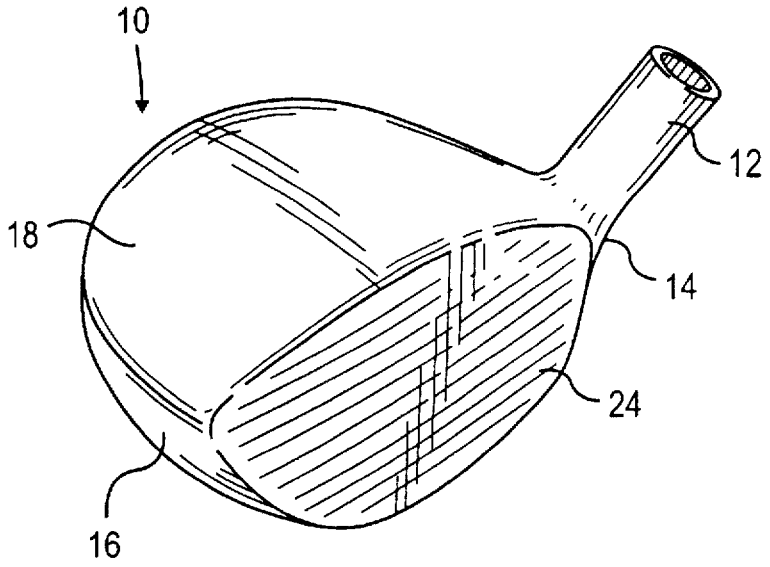
FIG. 7 is a top perspective view of the club head of FIG. 1.
Figure 7A:
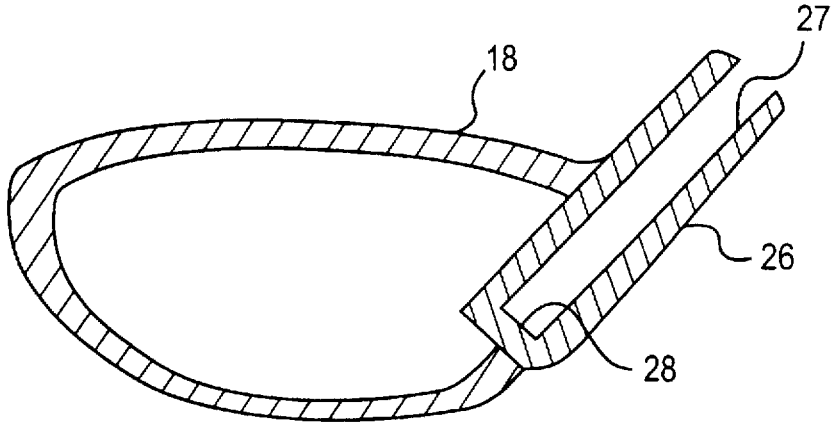
FIG. 7A is a cross sectional view of the club head of FIG. 1.
Figure 8:
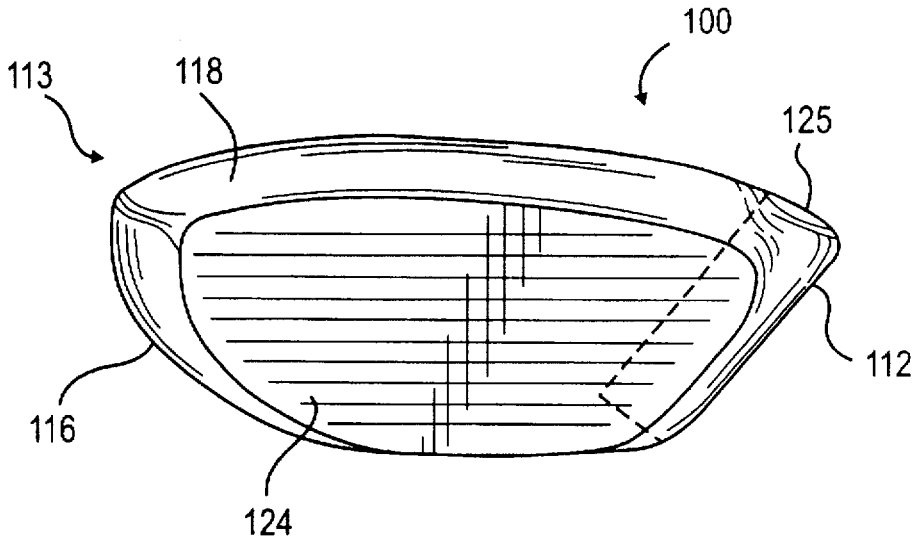
FIG. 8 is a front elevational view of the second embodiment of the present invention.
Figure 9:
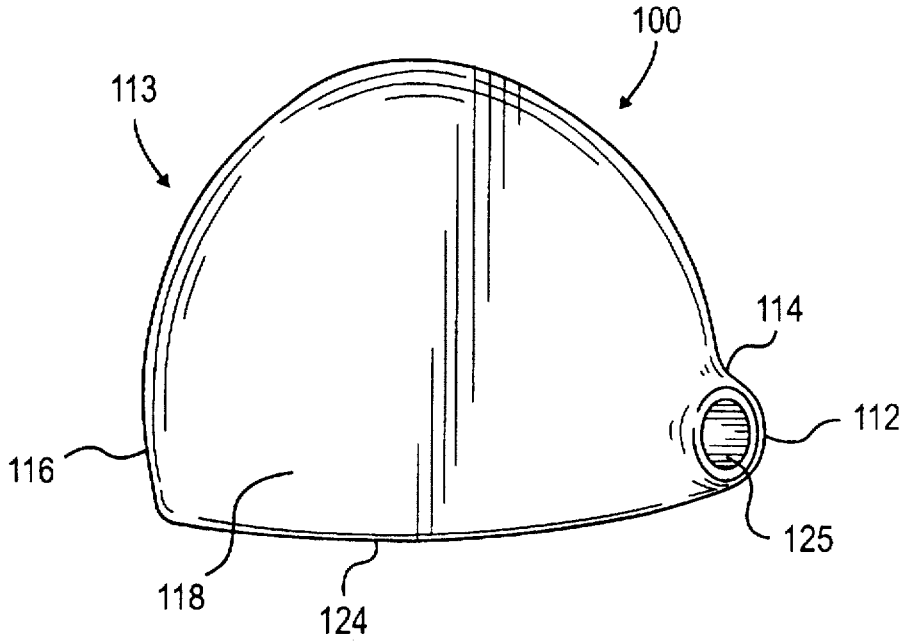
FIG. 9 is a top plan view of the club head of FIG. 8.
Figure 10:
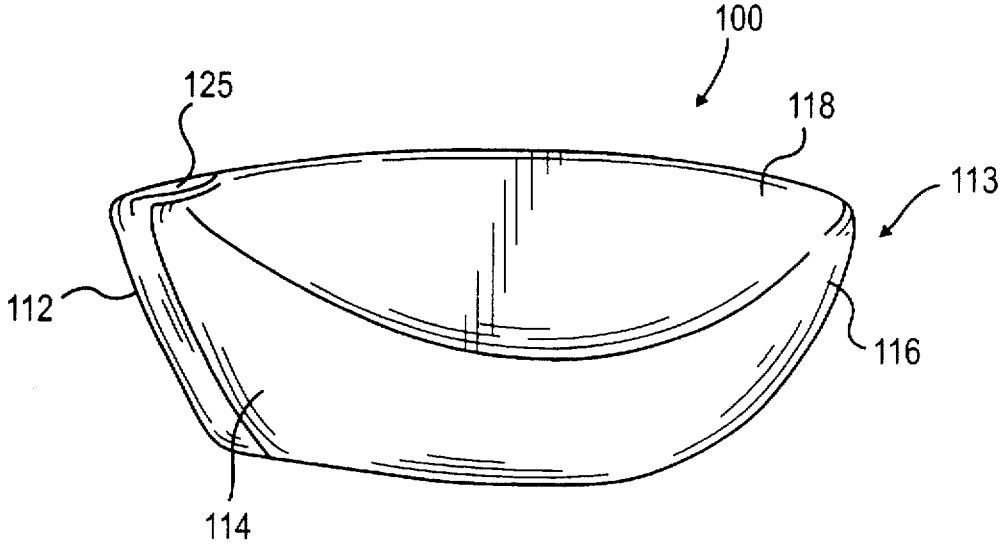
FIG. 10 is a rear elevational view of the metal wood club head of FIG. 8.
Figure 11:
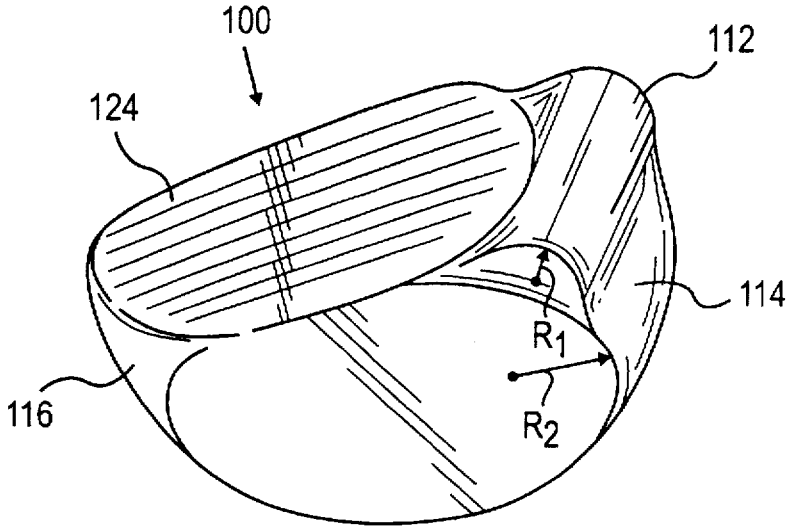
FIG. 11 is a bottom perspective view of the club head of FIG. 8.
Figure 12:
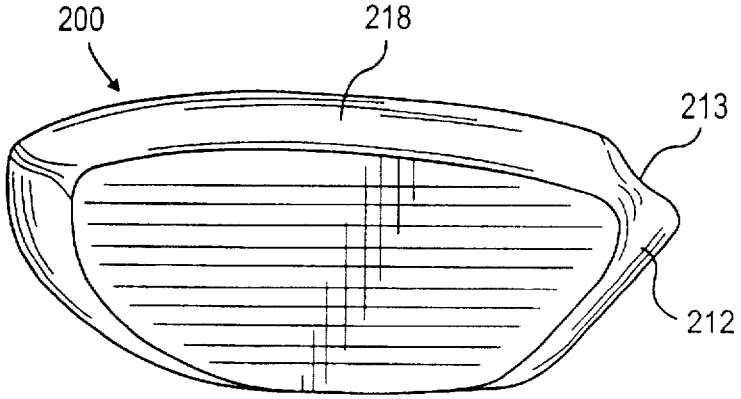
FIG. 12 is a front elevational view of a third embodiment of the present invention.
Figure 13:
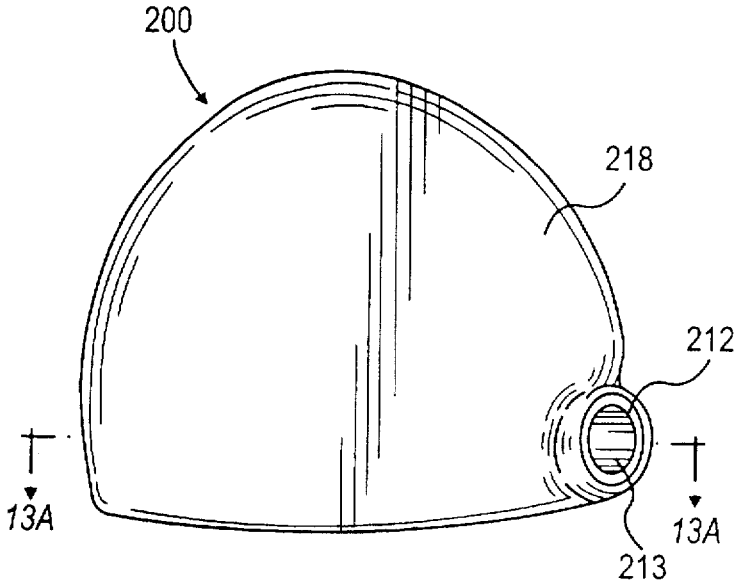
FIG. 13 is a top plan view of the club head of FIG. 12.
Figure 13A:
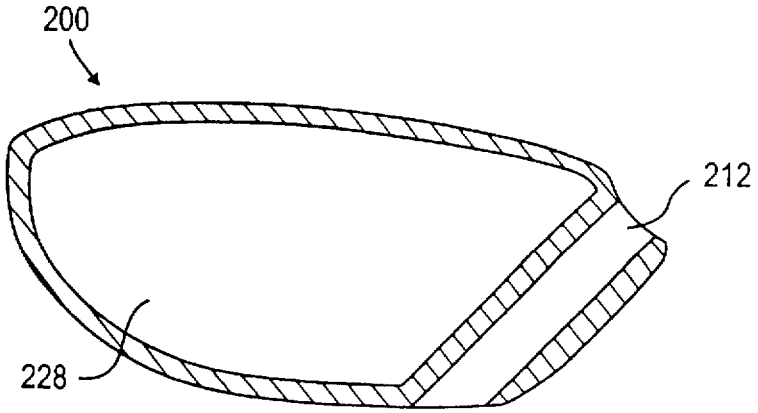
FIG. 13A is a cross sectional view of the club head of FIG. 12.
Figure 14:
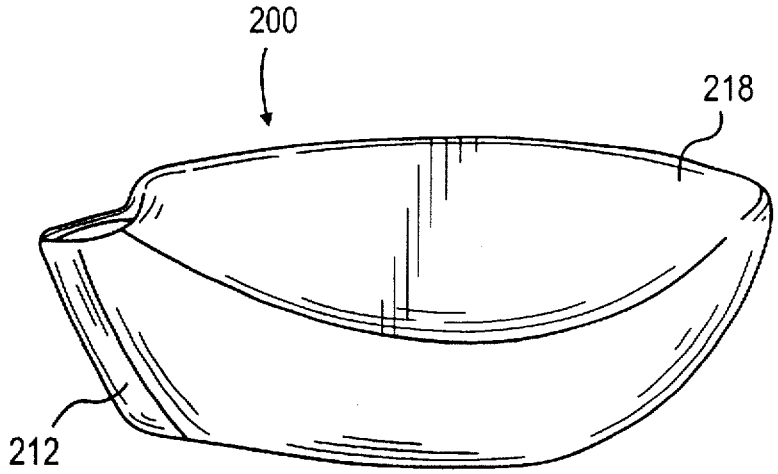
FIG. 14 is a rear view of the club head of FIG. 12.
Figure 15:
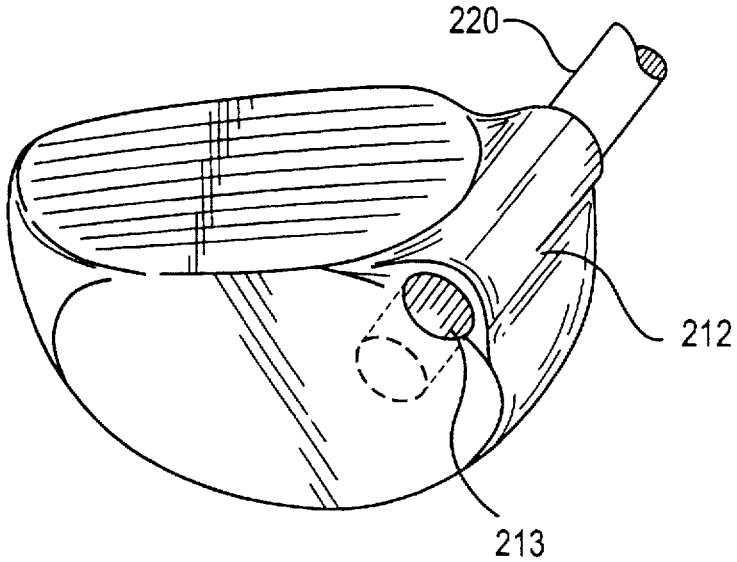
FIG. 15 is a bottom perspective view of the club head of FIG. 12.

As shown in FIG. 7A, the hosel 12 preferably has a cylindrical wall 27 forming a shaft socket that extends along the entire length of the hosel 12. The hosel 12 also preferably includes a bottom surface 28 against which the bottom of the shaft can rest. As shown in the illustrated embodiments, a significant portion of the cylindrical wall 27 is completely outside of the heel 14 of the shell while the remaining portion of the cylindrical wall extends into the internal club head cavity formed by the shell body 13 of the club head. This design provides optimum support for the shaft and a strong and stable connection between the shell body 13 and the club head shaft. The invention, however, also contemplates embodiments where the cylindrical wall of the hosel does not extend into the shell cavity or extends only partially into the shell cavity. For example, the club head could be designed to include flanges or partial walls within the shell cavity, rather than a completely cylindrical wall, to hold and restrain the shaft.

Figure 2:
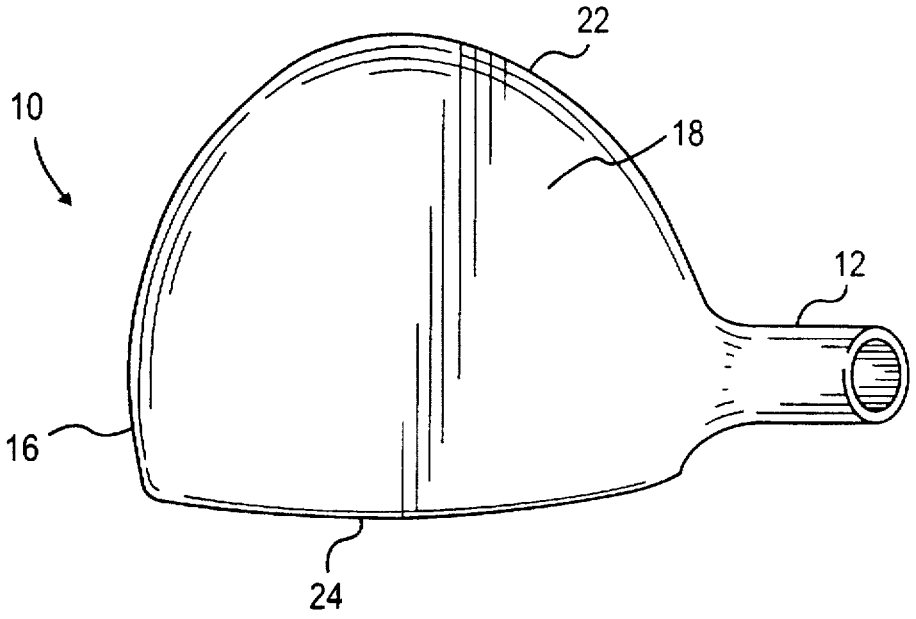
FIG. 2 is a top plan view of the club head of FIG. 1.
Figure 3:
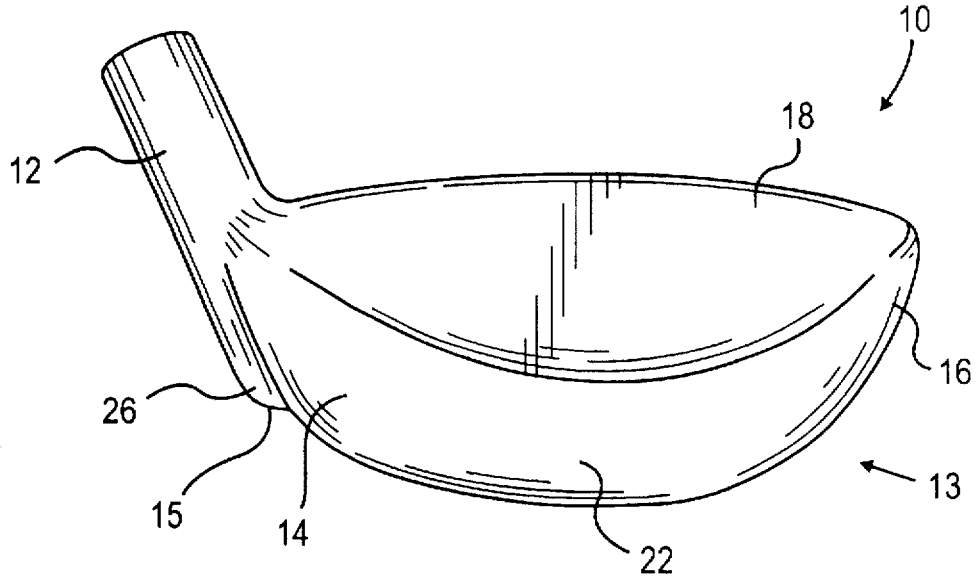
FIG. 3 is a rear view of the club head of FIG. 1.

The front surface of the hosel 12 of the club head is set back slightly from the striking face of club head, as best shown in FIG. 2. This design provides a clean break between the face of the shell body 13 and the hosel 12 and permits optimum weight and force distribution for a given club. In the embodiment illustrated in FIG. 1, the hosel is set back approximately 1/16 to 1/8 of an inch. As shown in the other embodiments, the degree of offset depends upon the overall configuration and design of the club.

As shown, the bottom of the illustrated hosel 12 is spaced above the bottom surface of the club head to avoid increased friction between the club head and ground as the ball is hit. In the illustrated embodiment, the bottom of the hosel 12 is spaced between 1/8 and 3/8 of an inch from the bottom surface, the hosel 12 has a total length of approximately 1¼ to 1½ inches, and the hosel 12 connects with the heel 14 of the shell body 13 along at least ½ of an inch, preferably at least ¾ of an inch.

Figure 4:
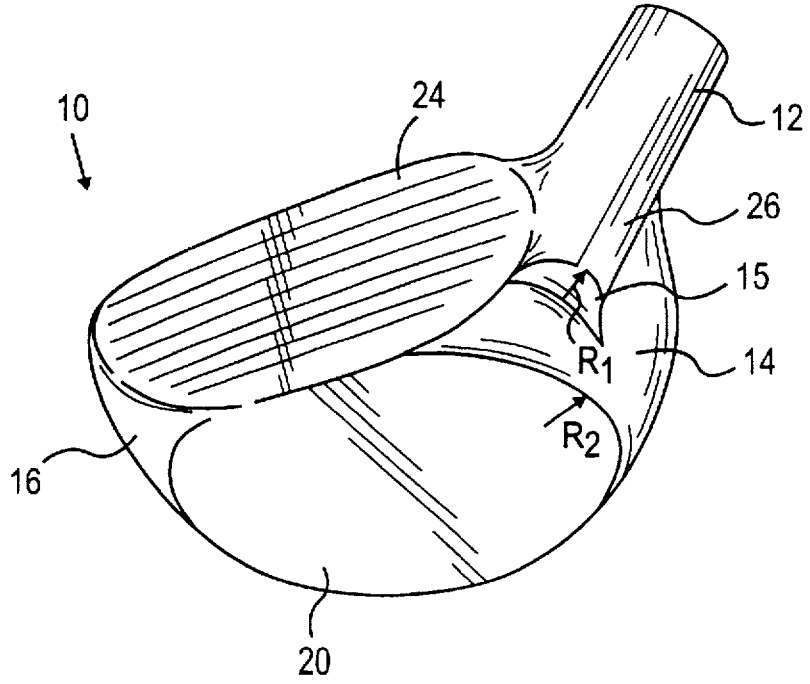
FIG. 4 is a bottom perspective view of the club head of FIG. 1.
Figure 5:
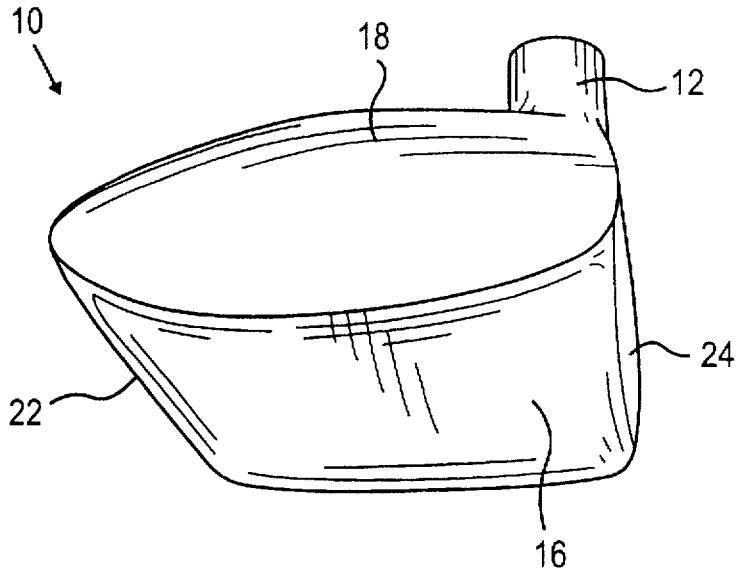
FIG. 5 is an end view of the club head of FIG. 1.
Figure 6:
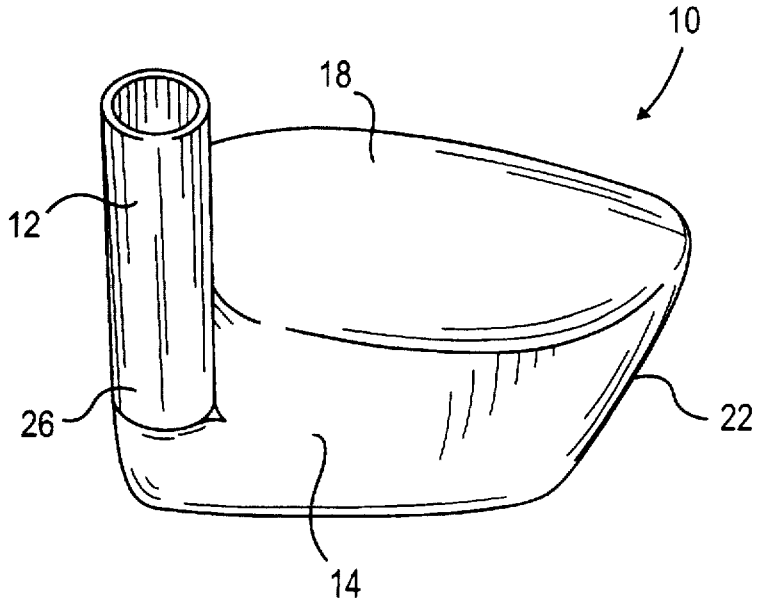
FIG. 6 is an end view of the club head of FIG. 1 from the opposite end of FIG. 5.

As can be seen, particularly with respect to FIG. 4, the hosel 12 is formed with a first radius R1 whereas the heel 14 is formed with a second, much larger radius R2 relative to the radius R1 of the hosel 12. This dual radius structure at the heel 14 is unique in the metal wood golf club art.

With the club head 10 of the present invention, the location of the hosel 12 provides more controlled leverage and improved stability, a more solid feel when ball contact is made, and results in greater accuracy and distance for same swing effort applied with conventional metal woods.

FIGS. 8, 9, 10 and 11 show a second embodiment of a golf club head 100 in accordance with the present invention which club head includes a heel 114, toe 116, upper surface or crown 118 and ball striking face 124. The club head 100 is hoselless above the upper surface 118 of the club head. In this embodiment, the hosel 112 and shaft socket 125 of the hosel is formed approximately level with the upper surface 118 of the club head 100. As can been seen, particularly with respect to FIGS. 10 and 11, hosel 112 has a smaller radius R1 which extends beyond and outwardly from a larger radius R2 of the heel 114, forming a dual radius configuration similar to the club head described hereinabove.

FIGS. 12, 13, 13A, 14 and 15 show a third embodiment of the golf club head 200 of the present invention including a hosel 212 and its shaft receiving socket having a shaft-receiving opening 213 located below the upper surface 218 of the club head. With this structure, a substantial portion of the hosel 212 is formed outside the shell cavity 228 and is open throughout its entire length whereby a shaft 220 may extend totally through the hosel 212 for added structural integrity. With the exception that this hosel 212 does not extend above the crown 218 and has openings at both the top and bottom to accept the club head shaft 220, the size, shaft, and characteristics of the hosel 212 are like those described with respect to the hosel in the first two embodiments.

Figure 16:
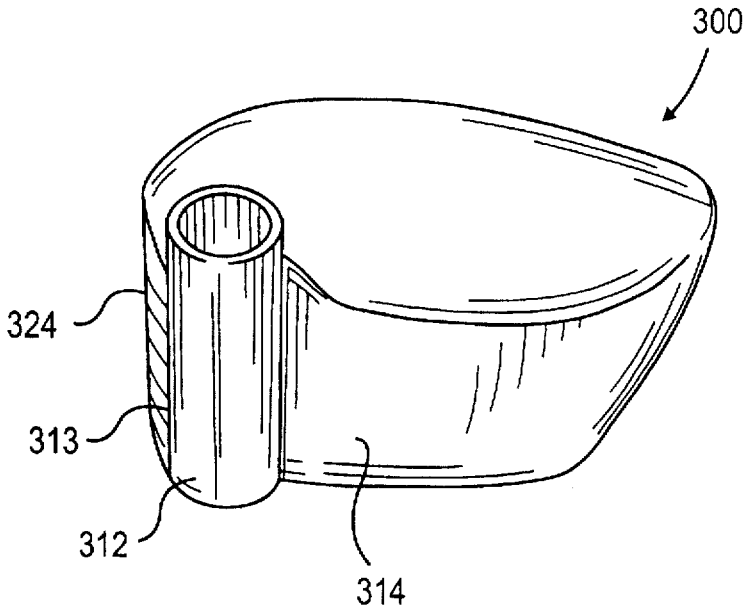
FIG. 16 is an end elevational view of a fourth embodiment of the present invention.
Figure 17:
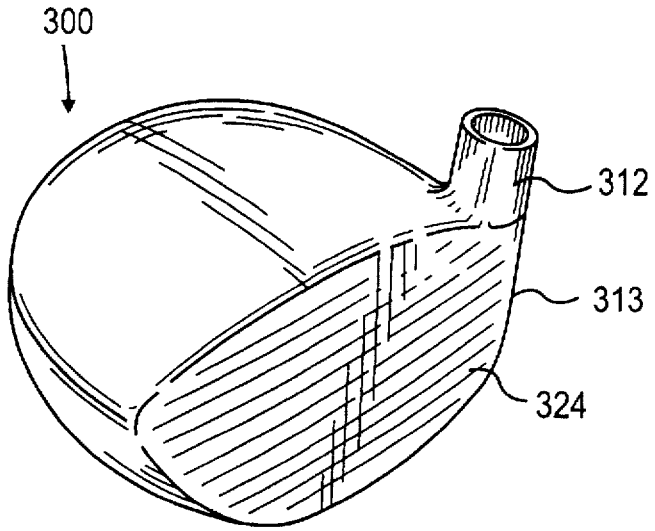
FIG. 17 is a top perspective view of the club head of FIG. 16.
Figure 18:
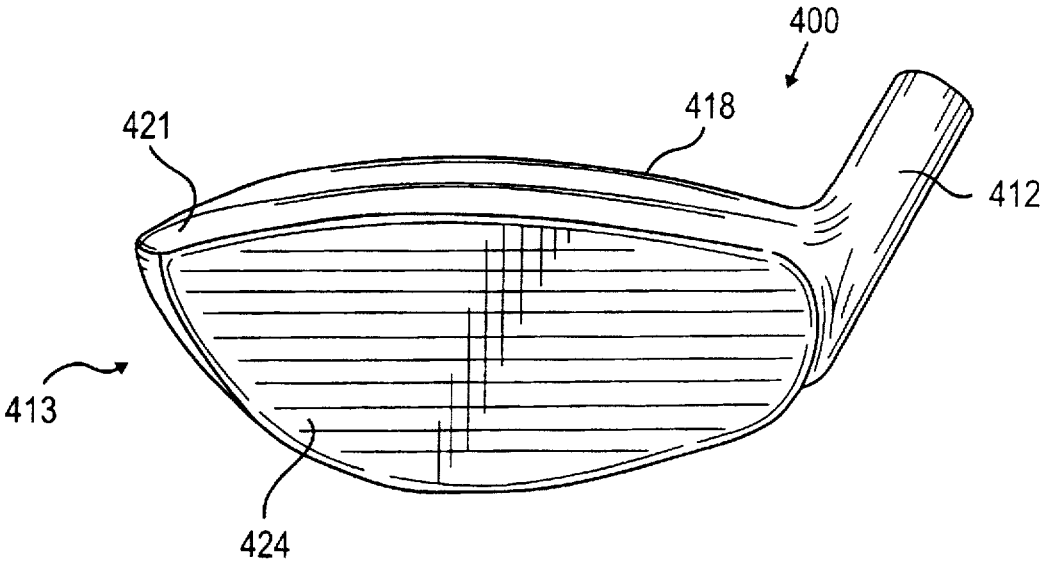
FIG. 18 is a front elevational view of a fifth embodiment of a golf club head in accordance with the present invention.
Figure 19:
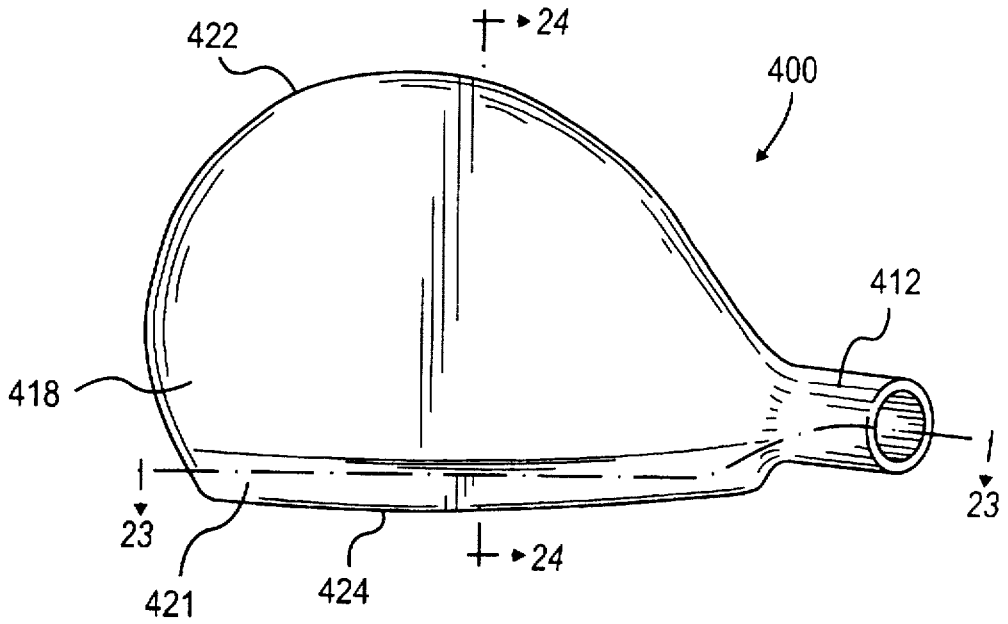
FIG. 19 is a top plan view of the club head of FIG. 18.
Figure 20:
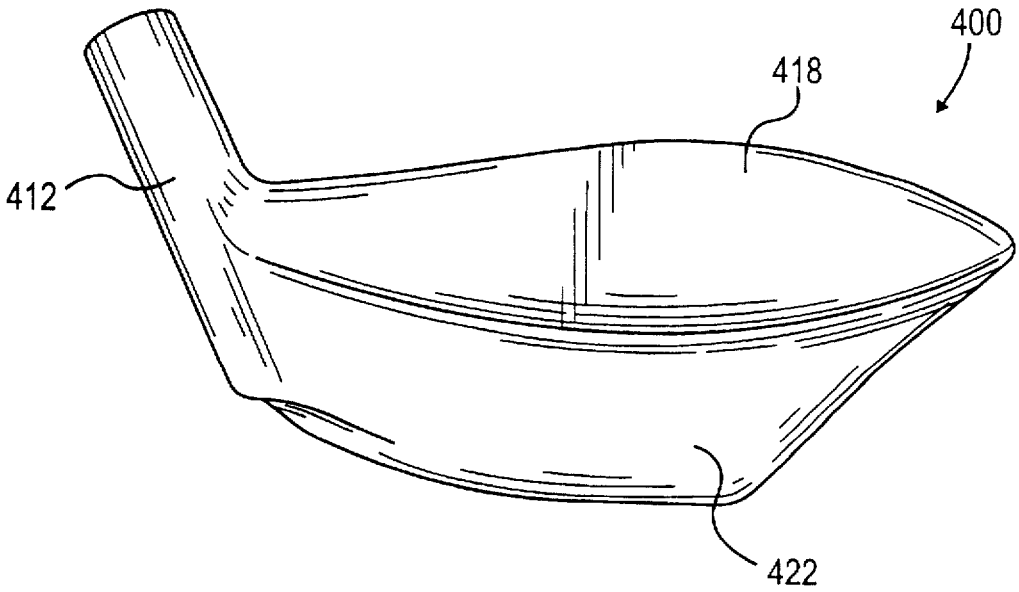
FIG. 20 is a rear elevational view of the golf club head of FIG. 18.
Figure 21:
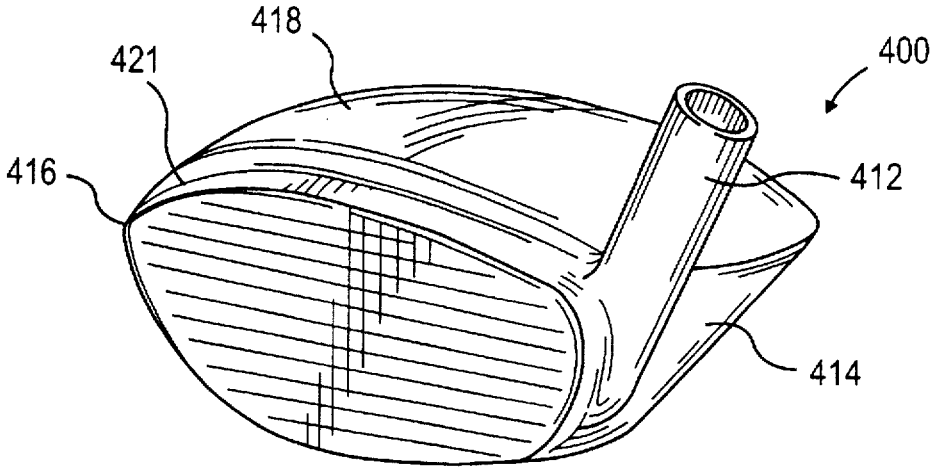
FIG. 21 is a front perspective view of the club head of FIG. 18.
Figure 22:
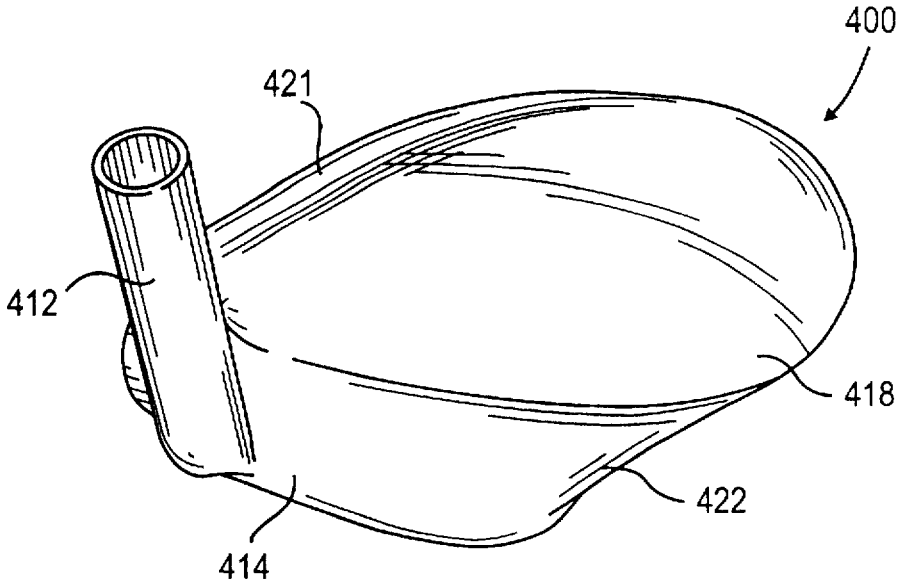
FIG. 22 is a rear perspective view of the club head of FIG. 18.

FIGS. 16 and 17 show a fourth embodiment of a golf club head 300 in accordance with the present invention including an outside hosel 312 and a ball striking face 324 which extends all the way to the front outer edge 313 of the hosel 312, in a toe to heel direction, rather than terminating at the edge of the heel 314. In this embodiment, the majority of the hosel 312 extends outward (in a toe to heel direction) of the heel surface 314 of the club head shell. The hosel 312, like that used in the first embodiment, preferably has a cylindrical wall from top to bottom, to provide an elongated, cylindrical socket for a shaft. The ball striking face 324 of the club head extends across the front of the hosel 312, providing a wrap around effect. As a result, for a given shell size, this embodiment provides a larger ball striking face 324, particularly at the heel 314 of the club head 300.

FIGS. 18 through 26 show still another embodiment of a golf club head 400 in accordance with the present invention. The club head 400 has a shell body 413 having a heel 414, toe 416, upper surface or crown 418, rear surface 422, shell cavity 428 and a ball striking face 424. The hosel 412 in this embodiment is like that disclosed in the first embodiment. In this embodiment, the club head 400 is shaped to include an aerodynamic configuration with the bottom surface 420 being substantially smaller than the upper surface 418. Preferably, the area of the upper surface or crown 418 of the club head is at least twice the area of the bottom surface of the club head.

The club head 400 also includes a set back ledge 421 which interfaces with the ball striking face 424 and the main portion of the upper surface 418. The ledge 421 is substantially perpendicular to the striking face of the club head and preferably has a width (from front to rear) within the range of ⅛ to approximately ½ of an inch. The club head includes an upwardly projecting transitional interface at the interface of the ledge 421 and the main portion of the upper surface 418 of the club head. In the embodiment illustrated in FIGS. 18–26, the transitional interface is in the form of a wall which is substantially perpendicular to the ledge. From the transitional interface rearward, the upper surface 418 extends upwardly to provide a conventional, arcuate crown.

Figure 27:
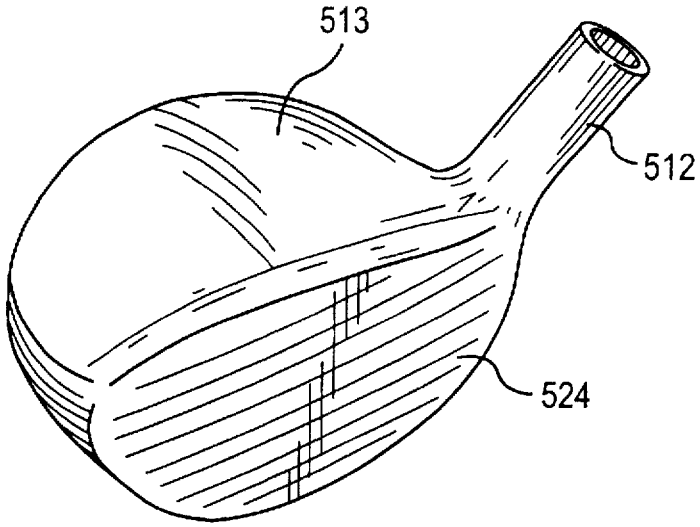
FIG. 27 is a front perspective view of a sixth embodiment of the present invention.

The air flow is considerably altered by set back ledge 421 as it encounters the improved configuration at the frontal portion of the upper surface 418. The improvement, the set back ledge 421, dramatically increases the overall aerodynamic results by more quickly developing a laminar air flow. As with the previous embodiments described hereinabove, the hosel 412 extends beyond the outer surface of the heel 414 forming a "two-radius" configuration. As shown in FIG. 27, a standard type hosel can also be used with ledge 421 and the peripheral mass, described below.

Figure 23:
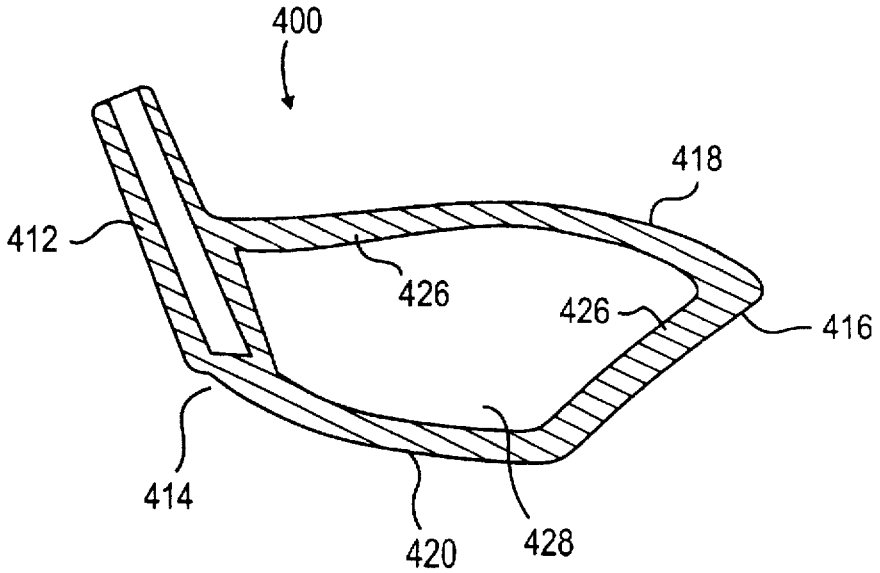
FIG. 23 is a sectional view taken along the line 23—23 of FIG. 19.
Figure 24:
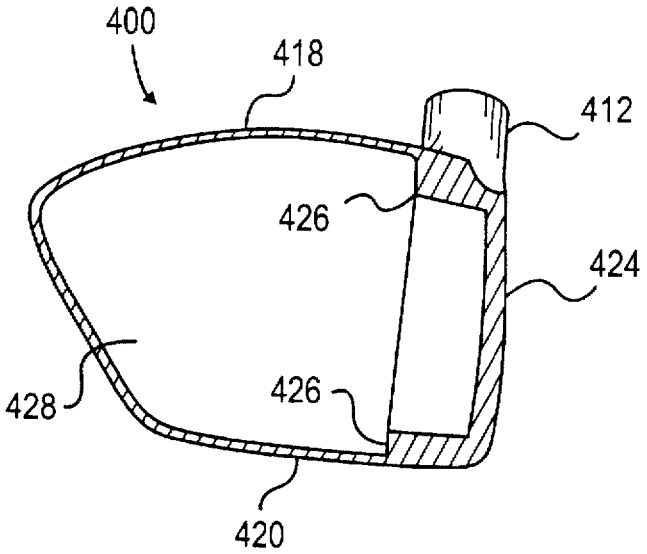
FIG. 24 is a sectional view taken along the line 24—24 of FIG. 19.

Referring to FIGS. 23–26, which are sectional views, the club head is provided with an inner peripheral weight member 426 which preferably extends around the inner rear peripheral edge of the ball striking face 424. Although the peripheral mass in the embodiment shown in FIG. 23 is continuous, it is possible to use a segmented peripheral mass. Although not shown in the drawings, the peripheral mass 426 can be segmented so that it is only along to the interface of the ball striking face and upper surface (underside of ledge 421), or also along the interface of the side walls and ball striking face, or also along the interface of the ball striking face and bottom surface.

The inclusion of the ledge 421, particularly when integrally combined with a peripheral mass 426 extending along at least a substantial portion of the interface of the ball striking face and upper surface (underside of the ledge), strengthening considerably the resultant club head and insulating the crown of the club head from impact forces that otherwise might crack, shatter or deform the crown. The shell of the rear portion of the club head therefore can be made of thinner materials that would otherwise not be possible.

Again referring to FIG. 23, it can be seen that the hosel 412 is formed laterally of the peripheral weight 426 and integrally attached thereto to add to the structural integrity of the club head 400.

Figure 25:
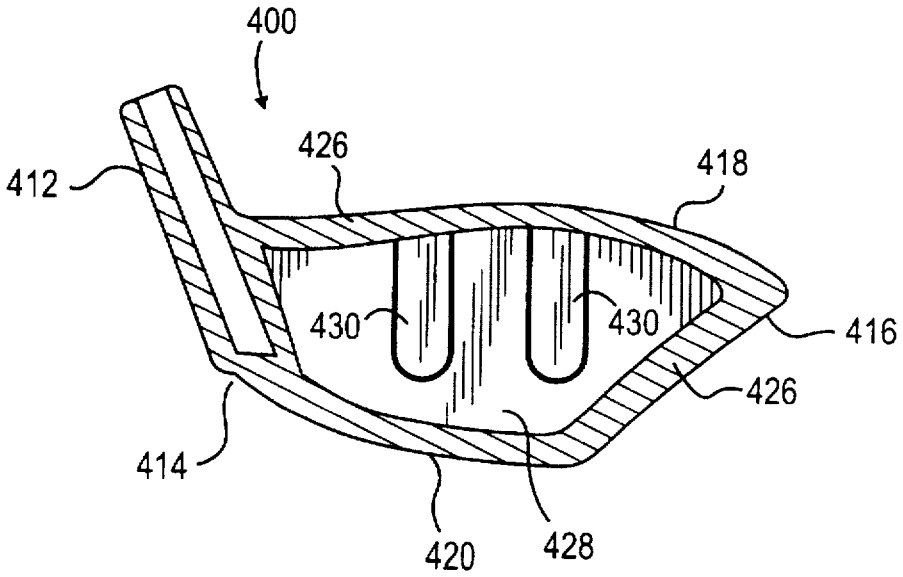
FIG. 25 is a sectional view similar to that of FIG. 23, but showing an alternate embodiment of weighting applied to the club shown in FIGS. 18–22.

The alternate embodiment shown in FIG. 25 is essentially the same as the club head in FIG. 23 except that it also includes two vertical wide bars 430 that project outwardly from the rear club face and extend into the peripheral mass 426. These vertical bars preferably are positioned on opposite sides of the club head's center of gravity and do not extend to the bottom of the club head. These bars provide reinforcement to the ball striking face and crown, permit controlled flexing of the ball striking face, and provide optimum weight distribution. The resultant combination of the upper peripheral mass 426 and the bars 430 provide increased mass and controlled flex at the top portion of the club head, which produces lower ball flight and greater roll and distance. Although this aspect is illustrated only in FIG. 25, it can be included in other embodiments of the invention.

Figure 26:
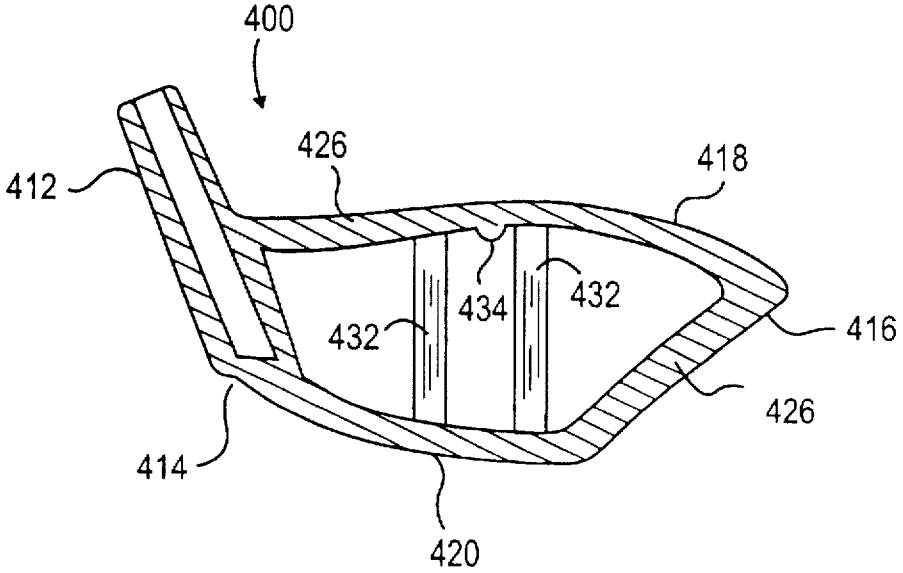
FIG. 26 is a sectional view similar to that of FIG. 23, but showing an alternate embodiment of weighting applied to the club shown in FIGS. 18–22.

In the alternate embodiment shown in FIG. 26, the club head includes a peripheral mass 426, like that shown in FIG. 23, and in addition includes a longitudinal mass or rib 434 that projects from the underside of the crown and extends from the peripheral mass 426 for at least 50% of the depth of the club head. Preferably this rib extends along most, if not all, of the length of the crown, from front to rear. The rib 434 also preferably connects with the peripheral mass 426 at the front of the club head. This longitudinal mass 434 further strengthens the club head to further minimize and prevent buckling of the crown. It also, in combination with the upper peripheral mass 426, adds weight to the top portion of the club head. Similar to the two vertical bars of the club head of FIG. 25, the club head of FIG. 26 includes two vertical bars 432 that extend from an upper part of peripheral mass 426 to a lower part of peripheral mass 426. If the club head only had a segmented peripheral mass 426 which did not include the interface of the ball striking face and the bottom surface, the two vertical bars would then extend to the bottom surface 420.

It should be noted that the ledge 421, peripheral mass 426 (in its entirety or segmented), vertical bars 430 and 432, and longitudinal mass 434 can be added to any of the other embodiments described herein without departing from the scope of the invention.

Figure 28:
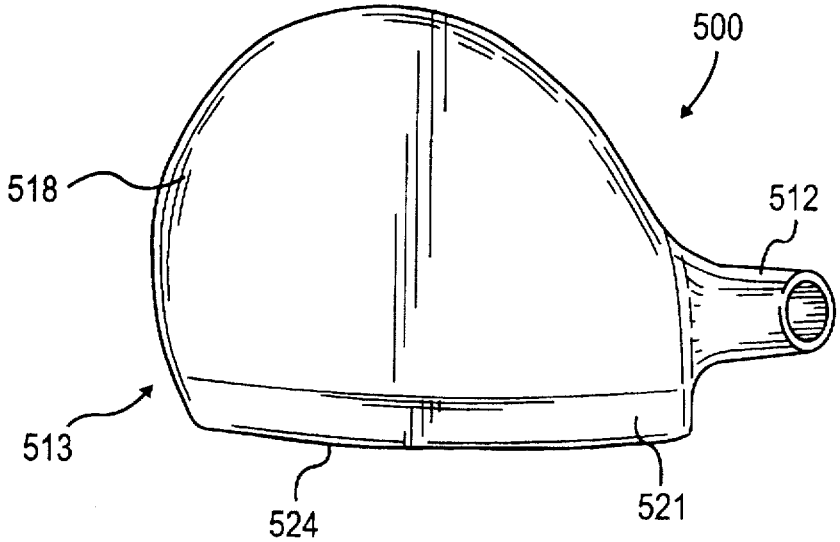
FIG. 28 is a top plan view of a seventh embodiment of the present invention.
Figure 29:
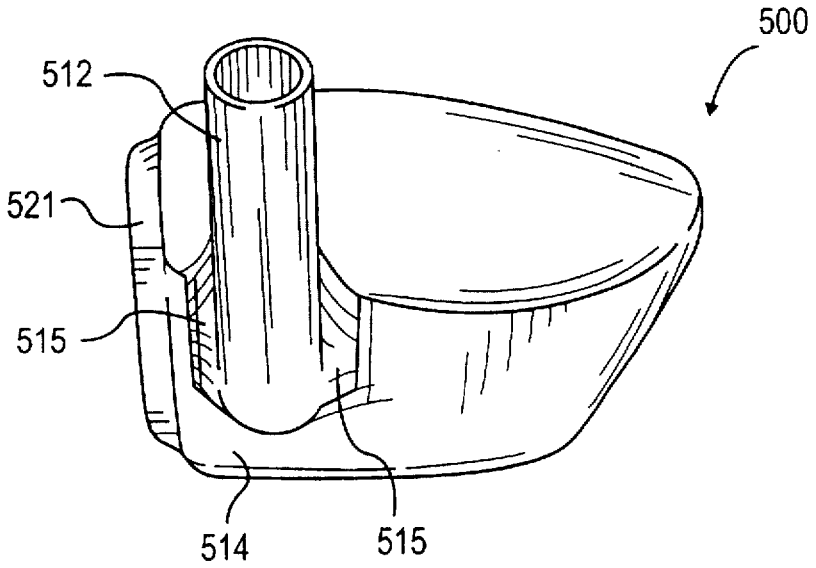
FIG. 29 is an end view of the club head of FIG. 28.
Figure 30:
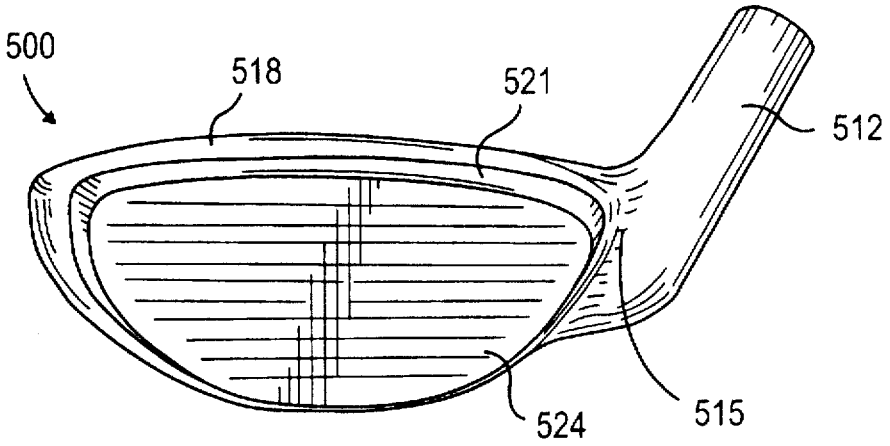
FIG. 30 is a front view of the club head of FIG. 28.

A seventh embodiment of the present invention is illustrated in FIGS. 28–30. In this embodiment substantially all, or all, of the hosel 512 extends outward of the heel 514 of the shell body 513 of the club head 500. In the preferred embodiment, the entire shaft socket of the hosel 512 is outward the shell body 513, and the hosel 512 includes flared sides 515 that extend beyond the outer diameter of the elongated cylinder of the hosel 512 and provide a smooth transition and strong connection between the hosel 512 and the shell 513. In addition, in this embodiment the hosel 512 is set back from the striking face 524 of the club head. This embodiment, like that of the fifth embodiment, includes a ledge 521 along at least the upper surface 518 of the club and a perimeter weight that preferably extends around the entire outer perimeter of the club face, immediately behind the ball striking face 524. The structure and operation of the ledge 521 is the same as that previously disclosed with respect to FIGS. 18–26.

Figure 31:
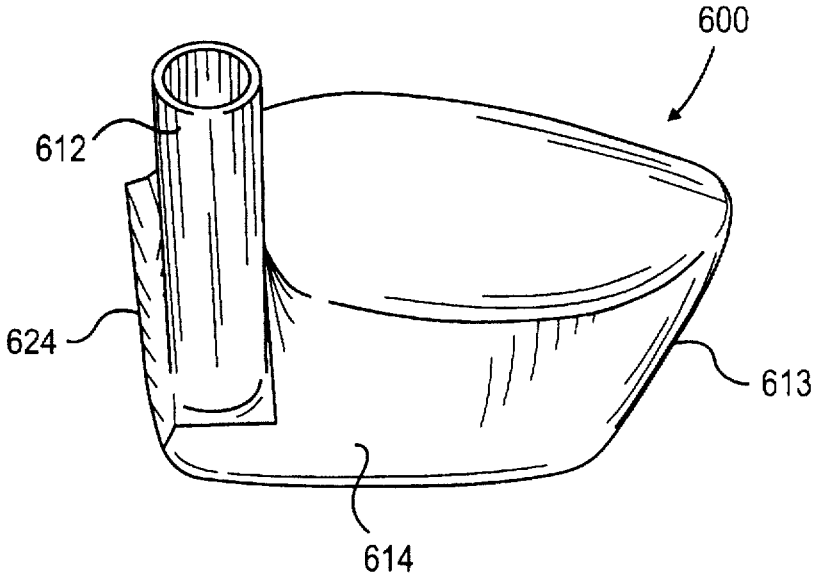
FIG. 31 is an end view of an eighth embodiment of the present invention.

An eighth embodiment of the present invention is shown in FIG. 31. This embodiment is substantially similar to the fifth embodiment except for two changes. The first change, as can be seen in FIG. 31, is that the hosel is positioned in a forward position, closer to the ball striking face. The second change is the hosel does not include the flared sides of the fifth embodiment.

Figure 32:
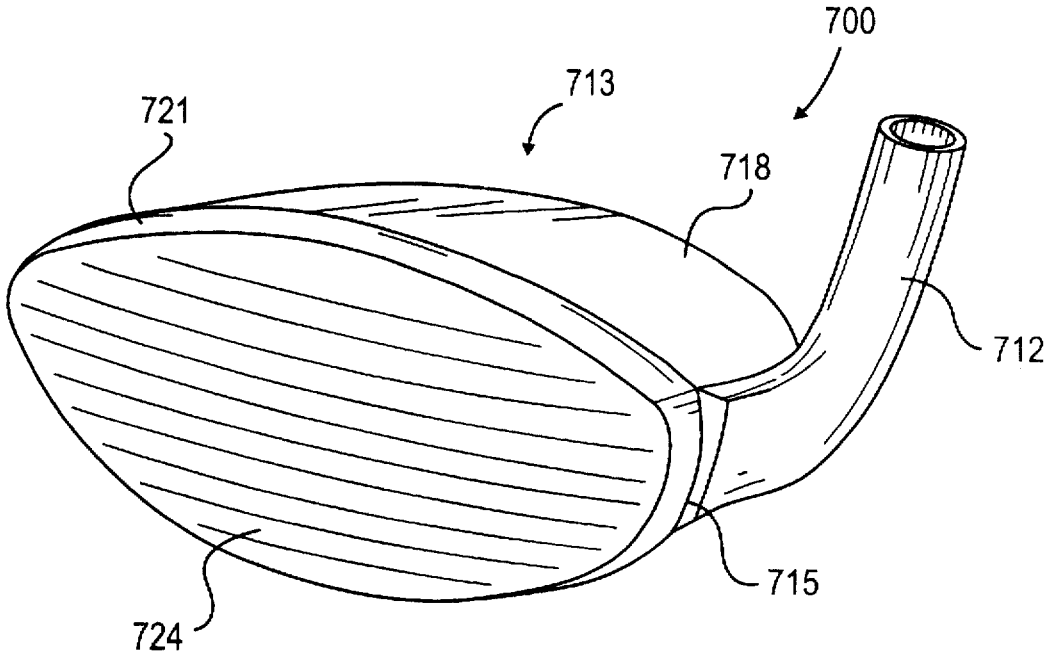
FIG. 32 is a front elevational view of a ninth embodiment of the present invention.
Figure 33:
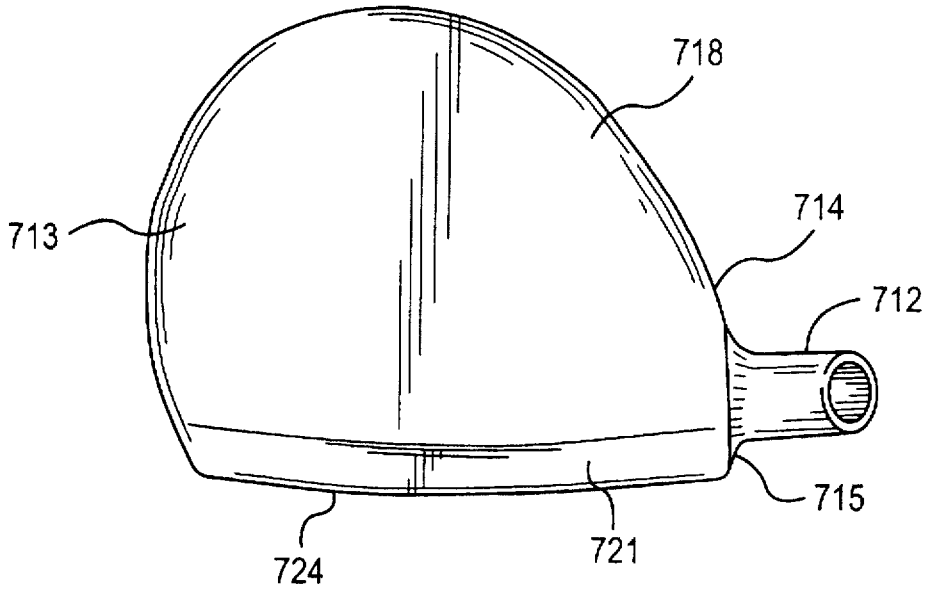
FIG. 33 is a top plan view of the club head of FIG. 32.

A ninth embodiment of the present invention is illustrated in FIGS. 32 and 33. In this embodiment, the entire cylindrical portion of the hosel 712, its cylindrical walls, and its shaft socket extend outwardly of the heel 714 of the shell body 713. The hosel 712 is also set back from the ball striking face 724 of the club head. In this embodiment, a buffer zone 715 provides transition between the shell 713 and the hosel 712. This buffer zone 715 preferably has a width, in a toe to heel direction, of at least one-sixteenth of an inch. This embodiment preferably includes the ledge 721 and perimeter weighting system described above. In this embodiment, the shaft socket preferably extends downward at least to a point in line with the club head's center of percussion.

Figure 34:
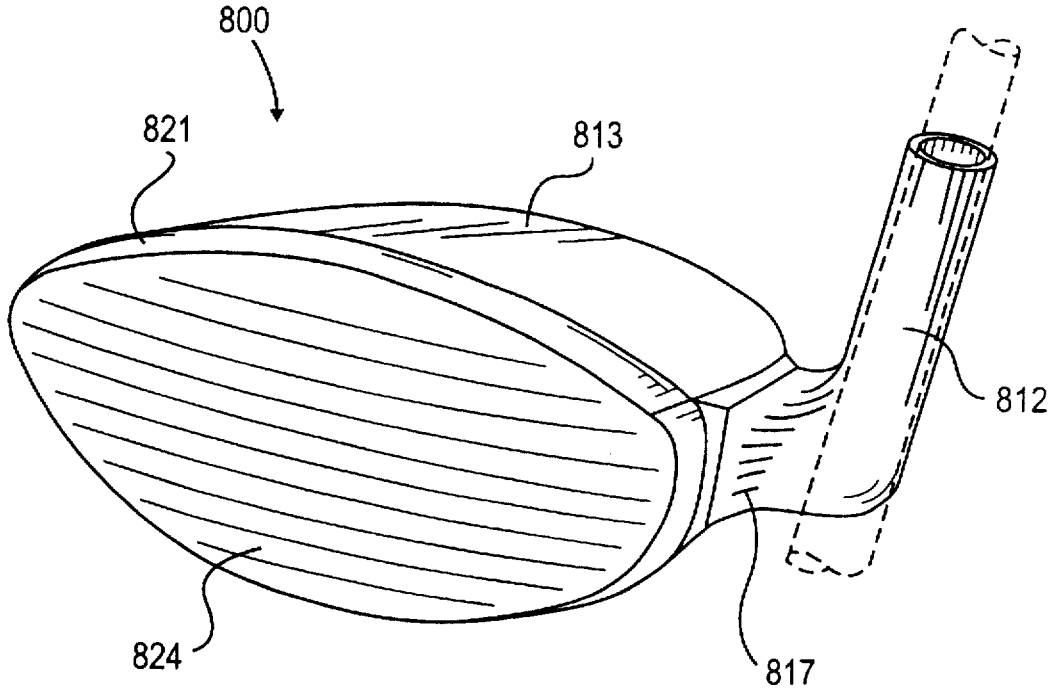
FIG. 34 is a front elevational view of a tenth embodiment of the present invention.

FIG. 34 illustrates a tenth embodiment of the present invention. This embodiment is like those shown in FIGS. 27–29, except that the hosel 812 includes an extension or elbow 817 between the cylindrical portion of the hosel and the shell 813 of the club head. The elbow 817 preferably has a width, in a toe to heel direction, of at least one quarter of an inch. For the reasons explained in U.S. patent application Ser. No. 08/124,205, filed Sep. 21, 1993, which is hereby incorporated by reference, this elbow 817 provides increased leverage and control to the club head.

It will be appreciated that the above described embodiments are exemplary only and that the offset hosel structure of the present invention may be formed on any size or shape of wood type club heads. By means of example only, the ledge shown in the embodiments of FIGS. 18–26 and 27–29 can also be incorporated into each of the other embodiments of club heads illustrated and described in this application. The spirit and scope of the invention will be appreciated by reference to the following claims.

I claim:

1. A metal wood type golf club head comprising:

a shell body having a toe, heel, ledge, upper surface, bottom surface, a hosel, a ball striking face, and a rear surface of the ball striking face inside the shell body, wherein the ledge interfaces with an upper portion of the ball striking face, extends in a heel to toe direction along at least half of the ball striking face, and extends rearwardly to interface with the upper surface of the club head at an upwardly projecting transitional interface, the ledge separating the ball striking face from the upper surface of the club head.

2. The golf club head of claim 1 wherein the ledge is substantially perpendicular to the ball striking face.

3. The golf club head of claim 2 wherein the ledge has a depth, in a front to rear direction, of at least one eighth of an inch.

4. The golf club head of claim 3 wherein the transitional interface projects gradually upwardly ledge from the ledge to a frontal portion of the upper surface.

5. The golf club head of claim 1 wherein the ledge extends, in a toe to heel direction, along substantially the entire interface of the upper portion of the ball striking face and the upper surface of the club head.

6. The golf club head of claim 1 further comprising a peripheral mass positioned along at least a majority of the interface of the rear surface of the ball striking face and an underside of the ledge of the club head, thereby providing added strength and stability to the club head.

7. The golf club head of claim 6 wherein said peripheral mass is thicker than the wall of the ball striking face immediately adjacent said peripheral mass and is thicker than the wall of the upper surface immediately adjacent said peripheral mass.

8. The golf club head of claim 6 wherein said peripheral mass extends downward along at least the upper portions of the respective interfaces between the ball striking face and the side walls, adjacent the heel and toe of the golf club head.

9. The golf club head of claim 6 wherein said peripheral mass also extends along at least a portion of the interface of the rear surface of the ball striking face and the bottom surface of the club head.

10. The golf club head of claim 6 wherein said peripheral mass extends around substantially the entire interface between the ball striking face and the upper surface, side walls, and bottom surface of the club head.

11. The golf club head of claim 6 further comprising a longitudinal mass extending from the peripheral mass for at least 50% of the depth of the club head, in a front to rear direction, under the upper surface and inside the shell body.

12. The golf club head of claim 6 further comprising a plurality of substantially vertical bars formed on the rear surface of the ball striking face and extending downwardly from said peripheral mass.

13. The golf club head of claim 6 wherein the hosel is integrally attached to a portion of said peripheral mass.

14. The golf club head of claim 13 wherein substantially all of the hosel extends outside the shell body.

15. The golf club head of claim 14 wherein the hosel includes a shaft-receiving socket extending along the entire length of the hosel.

16. The golf club head of claim 13 wherein at least a portion of the hosel extends outside the shell body.

17. The golf club head of claim 16 wherein the shaft receiving socket has an opening at both the top and the bottom of the hosel.

18. The golf club head of claim 16 wherein the front surface of the hosel serves as a continuation of the club head face.

19. The golf club head of claim 1 further comprising two secondary weight members formed on the rear surface of the ball striking face, one being positioned proximate the heel of the club head and the second being positioned proximate the toe of the club head.

20. The golf club head of claim 1 wherein the area of the upper surface of the club head is at least twice the area of the bottom surface of the club head, the sides of the shell body transitioning smoothly from the upper surface to the bottom surface.

21. The golf club head of claim 1 wherein the hosel has a shaft-receiving opening and the shaft-receiving opening of the hosel is formed even with the upper surface of the club head.

22. The golf club head of claim 1 wherein the hosel has a shaft-receiving opening and the shaft-receiving opening of the hosel is located below the upper surface of the club head.

23. A metal wood type golf club head comprising:

a shell body having a toe, heel, ledge, upper surface, bottom surface, a hosel, a ball striking face, and a rear surface of the ball striking face in the shell body, wherein the ledge interfaces with an upper portion of the ball striking face, extends in a heel to toe direction along at least half of the ball striking face, and extends rearwardly to interface with the upper surface of the club head at an upwardly projecting transitional interface, the ledge separating the ball striking face from the upper surface of the club head; and a peripheral mass positioned in the shell body along at least a majority of the interface of the ball striking face and the ledge of the club head, thereby providing added strength and stability to the club head.

24. The golf club head of claim 23, wherein the ledge has a depth, in a front to rear direction, of at least one eighth of an inch.

25. The golf club head of claim 24, wherein said peripheral mass is thicker than the wall of the ball striking face immediately adjacent said peripheral mass and is thicker than the wall of the upper surface immediately adjacent said peripheral mass.

26. The golf club head of claim 25 wherein said peripheral mass extends downward along at least the upper portions of the respective interface between the ball striking face and the side walls, adjacent the heel and toe of the club head.

27. The golf club head of claim 24 wherein the area of the upper surface of the club head is at least twice the area of the bottom surface of the club head, the sides of the shell body transitioning smoothly from the upper surface to the bottom surface.

28. The golf club head of claim 27 wherein said peripheral mass extends around substantially the entire interface between the ball striking face and the upper surface, side walls, and bottom surface of the club head.

29. The golf club head of claim 28 further comprising two secondary weight members formed on the rear surface of the ball striking face, one being positioned proximate the heel of the club head and the second being positioned proximate the toe of the club head.

30. A metal wood type golf club head comprising:

a shell body having a toe, heel, ledge, upper surface, bottom surface, a ball striking face, a rear surface of the ball striking face inside the shell body, and a hosel having at least a portion extending outside the shell body, wherein the ledge interfaces with an upper portion of the ball striking face, extends in a heel to toe direction along at least half of the ball striking face, and extends rearwardly to interface with the upper surface of the club head at an upwardly projecting transitional interface, the ledge separating the ball striking face from the upper surface of the club head.

31. A metal wood type golf club head comprising:

a shell body having a toe, heel, ledge, upper surface, bottom surface, a ball striking face, a rear surface of the ball striking face in the shell body, and a hosel having at least a portion extending outside the shell body, wherein the ledge interfaces with an upper portion of the ball striking face, extends in a heel to toe direction along at least half of the ball striking face, and extends rearwardly to interface with the upper surface of the club head at an upwardly projecting transitional interface, the ledge separating the ball striking face from the upper surface of the club head; and a peripheral mass positioned in the shell body along at least a majority of the interface of the ball striking face and the ledge of the club head, thereby providing added strength and stability to the club head.

* * * * *